US005787741A

United States Patent [19]

Shen

[11] Patent Number: 5,787,741

[45] Date of Patent: Aug. 4, 1998

[54] CARTRIDGE ASSEMBLY OF A PANIC PROOF LOCK

[76] Inventor: Mu-Lin Shen, No. 32, Lane 76, Sec. 5, Fu-An Rd., Tainan, Taiwan

[21] Appl. No.: 925,009

[22] Filed: Aug. 28, 1997

[51] Int. Cl.[6] ..... E05B 59/00

[52] U.S. Cl. ..... 70/107; 70/417; 70/451; 70/452; 292/21; 292/34

[58] Field of Search ..... 70/103, 107–111, 70/129, 276–278, 283, 417, 447–452, 466; 292/21, 33–36

[56] References Cited

U.S. PATENT DOCUMENTS

| | | | |
|---|---|---|---|
| 3,910,613 | 10/1975 | Nolin | 292/34 |
| 3,999,789 | 12/1976 | Maurits et al. | 292/21 X |
| 4,012,929 | 3/1977 | Solovieff | 70/417 X |
| 4,129,019 | 12/1978 | Urdal | 70/107 |
| 4,276,760 | 7/1981 | Nolin | 292/21 X |
| 4,418,552 | 12/1983 | Nolin | 292/21 X |
| 4,466,264 | 8/1984 | del Nero | 70/417 |
| 4,809,526 | 3/1989 | Shen | 70/107 |
| 4,838,053 | 6/1989 | Shen | 70/107 X |
| 4,979,767 | 12/1990 | Lin | 70/107 X |

*Primary Examiner*—Lloyd A. Gall

*Attorney, Agent, or Firm*—Oppenheimer Wolff & Donnelly LLP

[57] ABSTRACT

A cartridge assembly includes a base plate which is fixedly connected to a door and has two protruding portions engaged with two peripheries defining two passages of the door. Each of the protruding portions has a central hole and two positioning holes so as to connect to two latch bolts retractably received in the door by bolts. Two bosses extend from the base plate and each has a threaded recess defined therein. A cartridge has at least two lugs extending therefrom and through each of which an aperture is defined so that two bolts extend through the apertures and are threadedly engaged with the threaded recesses. An interior panel is mounted to the cartridge and the base plate.

2 Claims, 5 Drawing Sheets

CARTRIDGE ASSEMBLY OF A PANIC PROOF LOCK

BACKGROUND OF THE INVENTION

1. Field of the Invention

The present invention relates to a cartridge assembly and, more particularly, to an improved cartridge assembly of a panic proof lock which ensures an operation space defined in the cartridge will not be deformed during installing.

2. Brief Description of the Prior Art

A cartridge of a panic proof lock is disclosed in U.S. Pat. No. 4,809,526 to Chao C. Shen, issued on May 7, 1989. Such a cartridge allows the lock to be unlocked by rotating only the interior knob when a user is in an emergency situation. Generally, referring to FIGS. 1 and 2, a cartridge 82 is disposed to a door 86 by bolts 90 which extend through is the cartridge 82. Two latch bolts 861, 862 are retractably and laterally received in the door 86 and threadedly engaged with a keyed rosette 80 and a keyed exterior knob 81. An interior panel 83 then is mounted to the cartridge 82 and a thumb turn 85 and an interior knob 84 respectively have an extending portion thereof extending through the cartridge 82 and are engaged with the rosette 80 and the exterior knob 81. When rotating the interior knob 84, the two latch bolts 861, 862 will be retracted into the door 86 by operating members 820 disposed in the cartridge 82. A space is defined between a front wall 821 and a rear wall 822 of the cartridge 82 so that the operating members 820 can be moved and operated. However, the space will be narrowed if the bolts 90 are tightened excessively so that the rear wall 822 of the cartridge 82 is deformed thus restricting movement of the operating members 820 as shown in FIG. 3.

The present invention intends to provide an improved cartridge assembly which ensures that the space in the cartridge will not be narrowed during installing so as to mitigate and/or obviate the above-mentioned problem.

SUMMARY OF THE INVENTION

The present invention provides a cartridge assembly of a panic proof lock and comprises a base plate fixedly connected to a door, a cartridge and an interior panel. The base plate has at least two protruding portions extending from a front surface thereof so as to be engaged with passages defined in the door. Each of the protruding portions has a central hole and two positioning holes defined therethrough. At least two bosses extend from a rear surface of the base plate and each of the bosses has a threaded recess defined therein.

The cartridge has an operating mechanism operatably received between a front and a rear wall thereof. Two operation holes are respectively defined through the cartridge which has at least two lugs extending therefrom through each of which an aperture is defined. The two apertures are located in alignment with the two bosses. The two operation holes are located in alignment with the central holes so that the cartridge is connected to the base plate by respectively extending two bolts through the two apertures and engaged with the threaded recesses.

The interior panel has a peripheral flange extending therefrom so as to mount to the base plate and the cartridge. Two installation holes are respectively defined through the interior panel and located in alignment with the operation holes so that a thumb turn and an interior knob are disposed to the interior panel and connected to two latch bolts retractably received in the door via the aligned installation holes, the operation holes, the central holes and the passages.

It is an object of the present invention to provide a cartridge assembly of a panic proof lock wherein the cartridge can not be deformed when the lock is being installed.

It is another object of the present invention to provide a cartridge assembly of a panic proof lock wherein the cartridge has two lugs extending therefrom and through each of which an aperture is defined. Furthermore, a base plate fixedly connected to the door has two bosses in each of which a threaded recess is defined such that the cartridge is connected to the base plate by extending bolts through the apertures and engaging with the threaded recesses.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
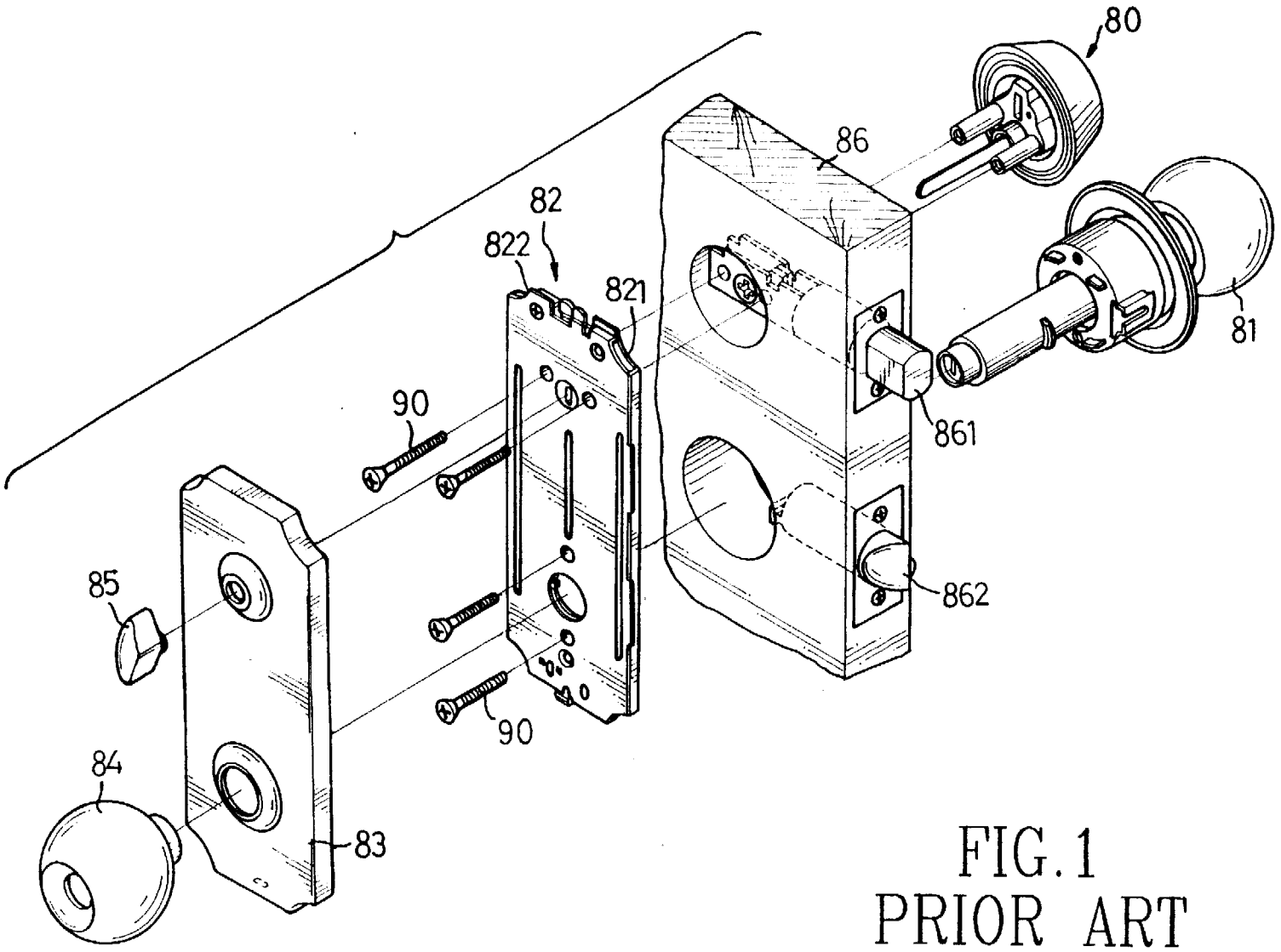
FIG. 1 PRIOR ART
FIG. 1 is an exploded view of a conventional panic proof lock having a cartridge assembly.
Figure 2:
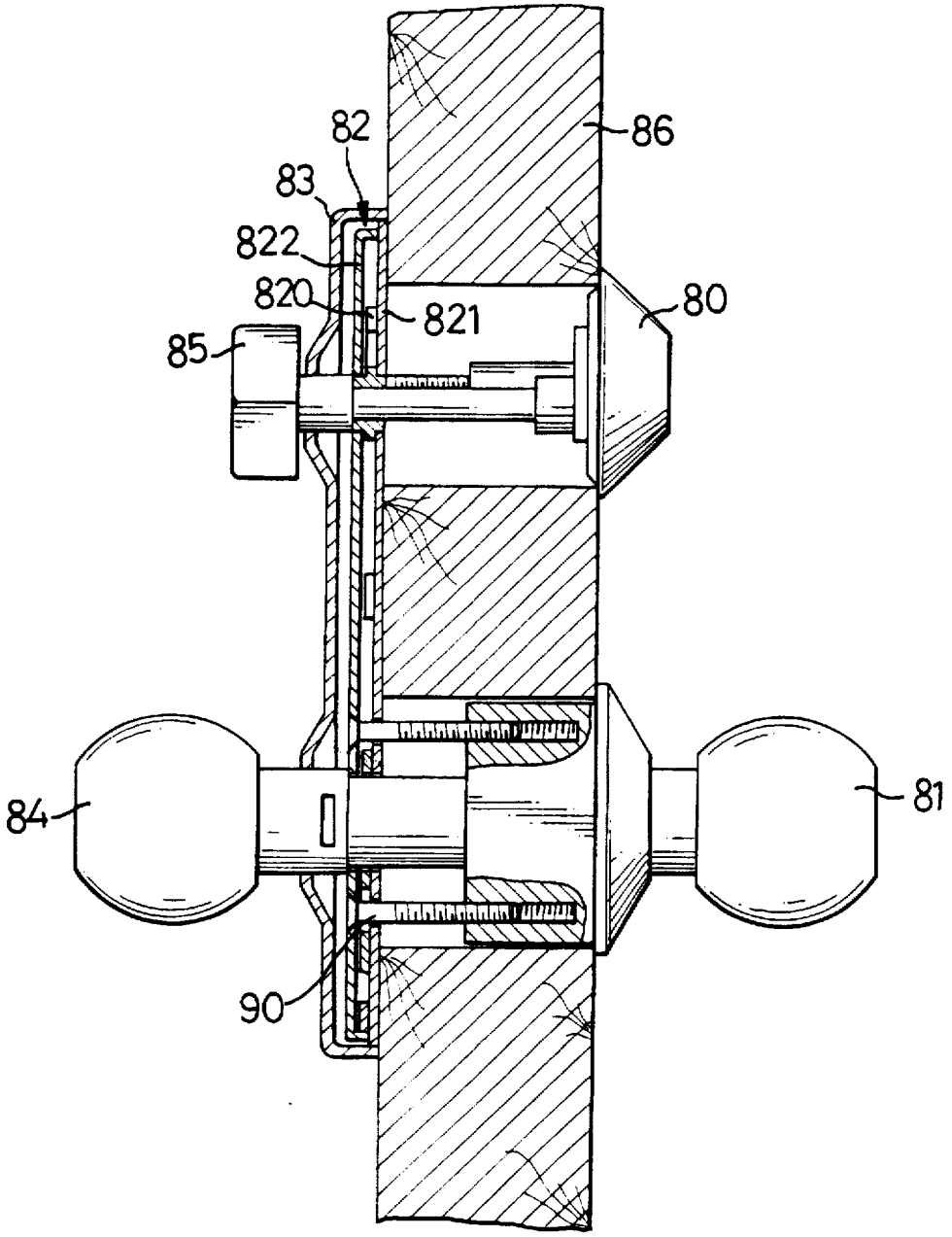
FIG.2 PRIOR ART
FIG. 2 is a side elevational view, partly in section, of the conventional panic proof lock as shown in FIG. 1.
Figure 3:
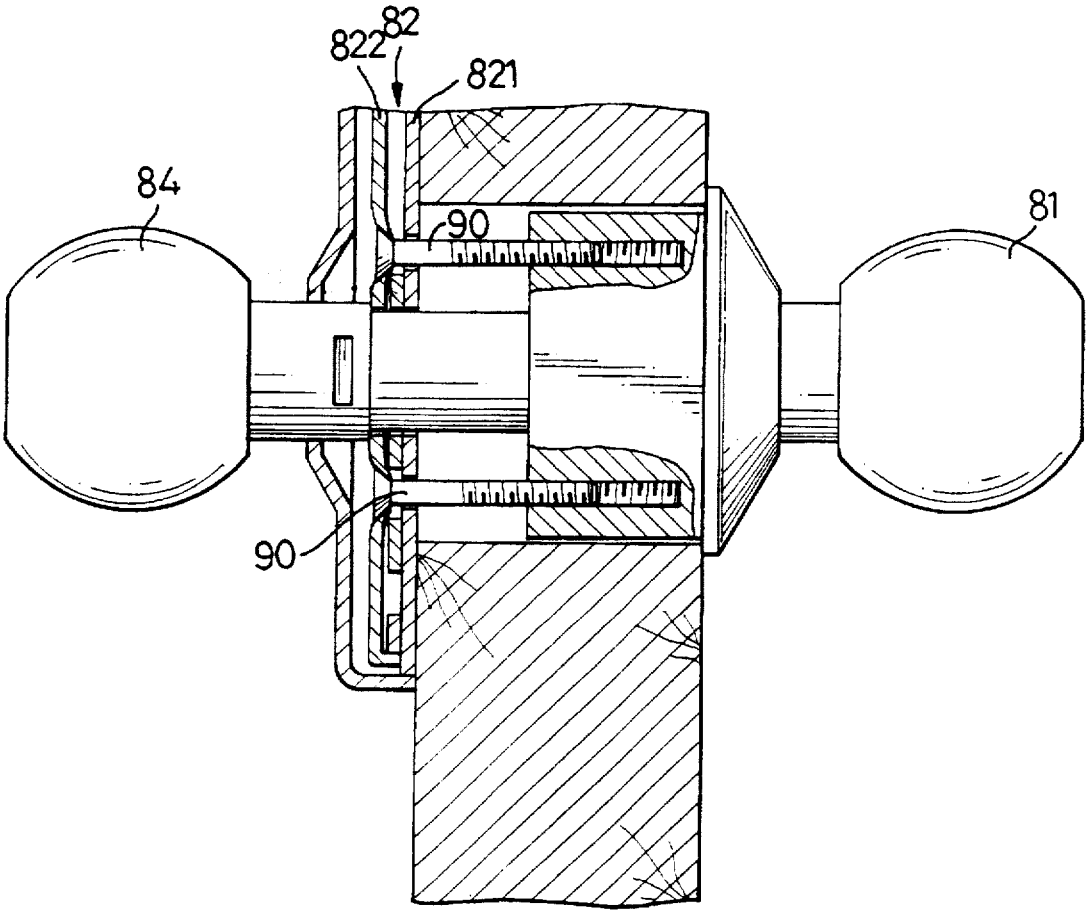
FIG.3 PRIOR ART
FIG. 3 is a side elevational view, partly in section and in an enlarged scale, of the conventional cartridge deformed due to an excessive force having been applied to the bolts extending therethrough.
Figure 4:
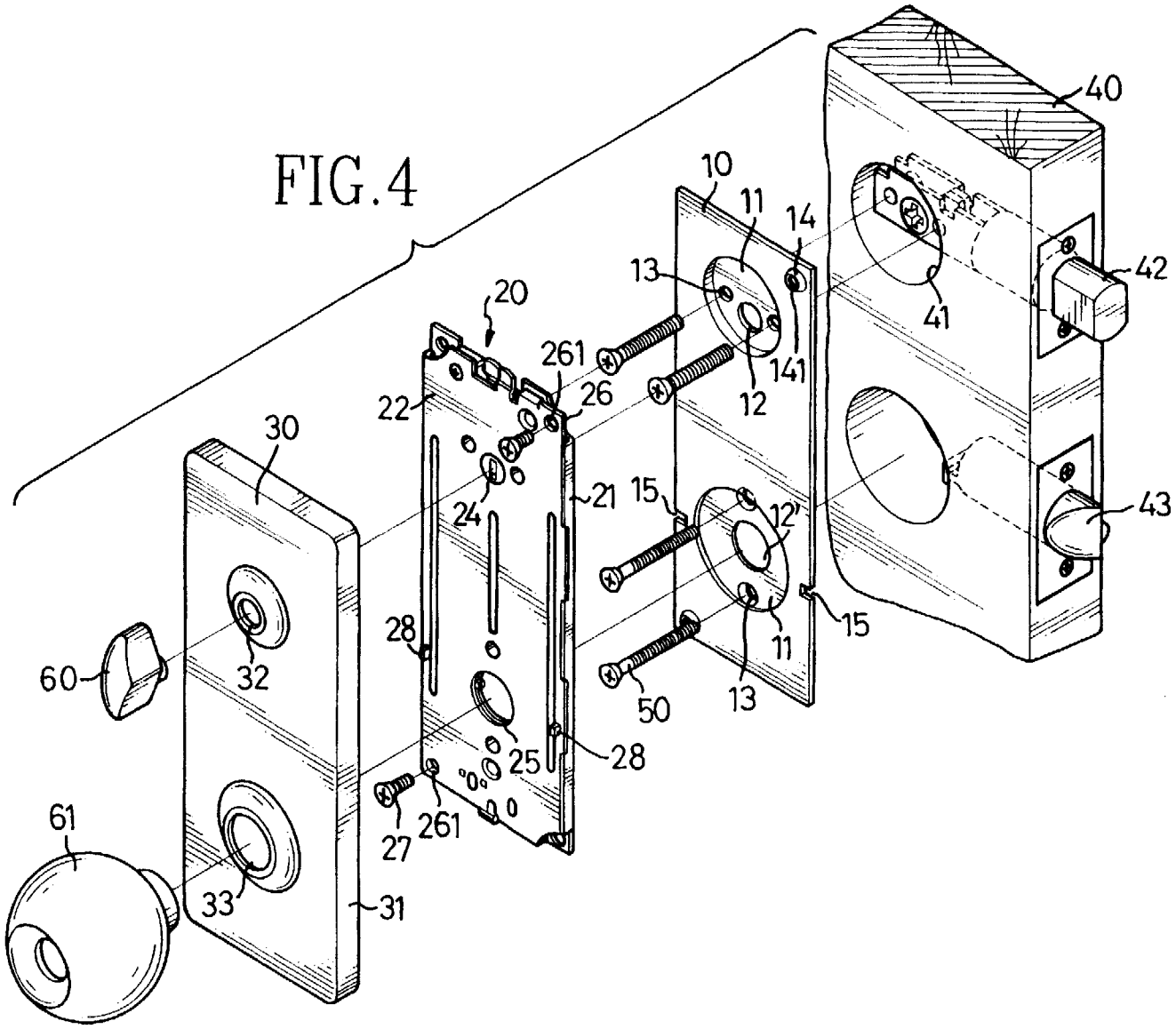
FIG. 4 is an exploded view of a cartridge assembly of a panic proof lock in accordance with the present invention.
Figure 5:
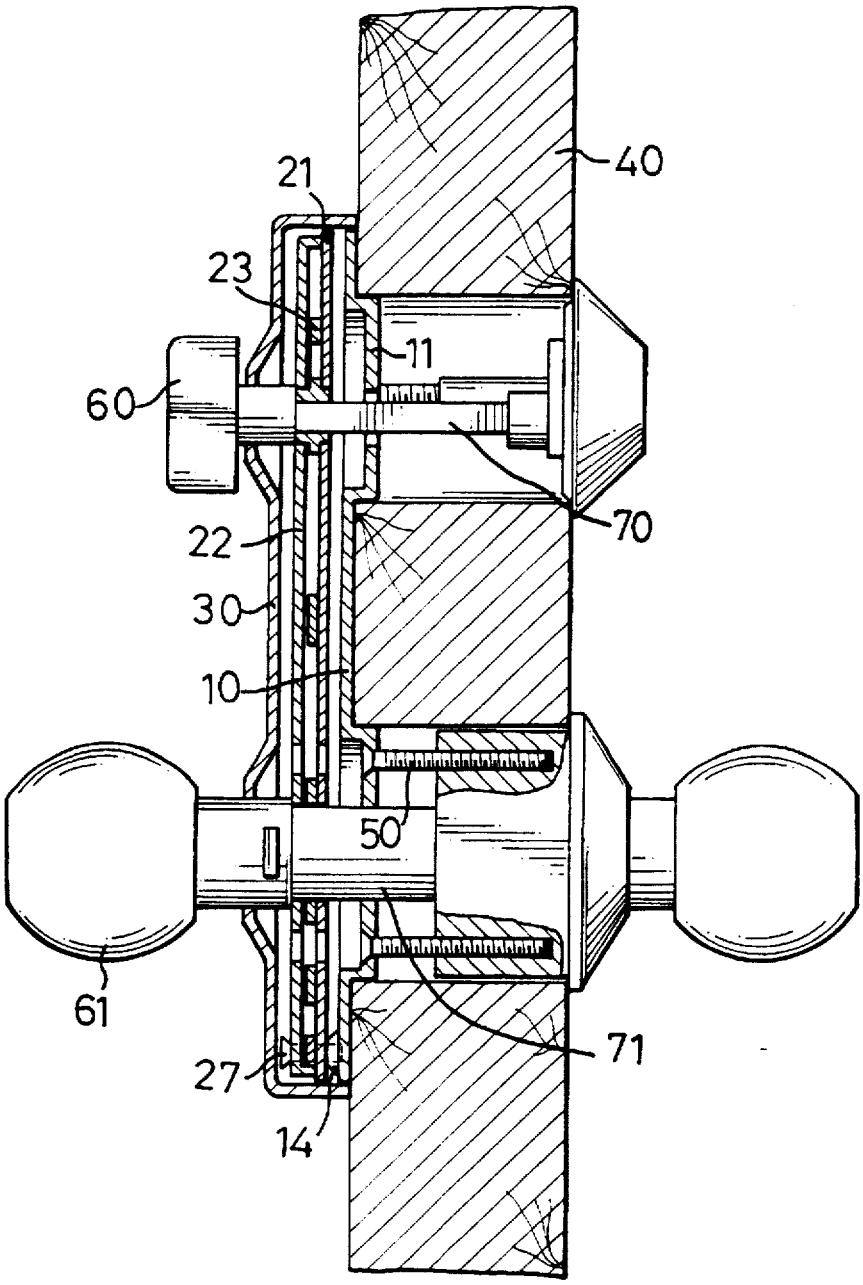
FIG. 5 is a side elevational view, partly in section, of a panic proof lock having the cartridge assembly in accordance with the present invention.

Referring to FIGS. 4 and 5, a cartridge assembly in accordance with the present invention generally includes a base plate 10 having two circular protruding portions 11 extending from a front surface thereof so as to be engaged with two circular peripheries respectively defining two passages 41 in a door 40 wherein two latch bolts 42, 43 are transversely and retractably received and accessed via the passages 41. Each of the protruding portions 11 has a central hole 12/12' and two positioning holes 13 defined therethrough so that four bolts 50 respectively extend through the four positioning holes 13 and fixedly connect to the two latch bolts 42, 43 so that the base plate 10 is fixedly attached to the door 40. At least two bosses 14 are located on two opposite corners on a diagonal axis of the base plate 10 and extend from a rear surface of the base plate 10 and each of the bosses 14 has a threaded recess 141 defined therein. The base plate 10 further has two notches 15 defined in each one of two sides thereof.

A cartridge 20 comprises a front wall 21 and a rear wall 22 mounted to the front wall 21 so as to define a space therebetween for an operating mechanism 23 to be operatably received in the space. Two operation holes 24, 25 are respectively defined through the cartridge 20 and located in alignment with the central holes 12, 12'. The cartridge 20 has at least two lugs 26 extending from two opposite corners on a diagonal axis thereof and each of the lugs 26 has an aperture 261 defined therethrough wherein the two apertures 261 are located in alignment with the two bosses 14 so that the cartridge 20 is fixedly connected to the base plate 10 by respectively extending two bolts 27 through the two apertures 281 and engaging with the threaded recesses 141 of the bosses 14. The cartridge 20 has two studs 28 respectively extending from two opposite sides of the front wall 21 thereof and toward the two notches 15 so as to be received in the notches 15.

An interior panel 30 has a peripheral flange 31 extending therefrom so as to receive therein the base plate 10 and the cartridge 20. Two installation holes 32, 33 are respectively defined through the interior panel 30 and located in alignment with the operation holes 24, 25 so that a thumb turn 60 extends through the installing hole 32 and is connected to an actuating plate 70 which extends through the latch bolt 42, the central hole 12 and the operation hole 24, and an interior knob 61 extends through the installing hole 33 and is connected to an actuating shaft 71 which extends through the other latch bolt 43, the central hole 12' and the operation hole 25.

Accordingly, the base plate 10 is directly connected to the two latch bolts 42, 43 received in the door 40 by bolts 50 and the cartridge 20 is separately connected to the base plate 10 by the bosses 14 and bolts 27, the bolts 27 only extending through the lugs 26 and engaging with the threaded recesses 141 of the bosses 14 so that the space defined between the front wall 21 and the rear wall 22 of the cartridge 20 will never be deformed during installation of the lock.

Although the invention has been explained in relation to its preferred embodiment, it is to be understood that many other possible modifications and variations can be made without departing from the spirit and scope of the invention as hereinafter claimed.

What is claimed is:

1. A cartridge assembly of a panic proof lock, comprising:

a base plate fixedly connected to a door and having at least two protruding portions extending from a front surface thereof so as to be engaged with two peripheries defining two passages in said door, each of said protruding portions having a central hole and two positioning holes defined therethrough, at least two bosses extending from a rear surface of said base plate and each of said bosses having a threaded recess defined therein;

a cartridge comprising a front wall and a rear wall, an operating mechanism operatably received between said front and said rear wall, two operation holes respectively defined through said cartridge, said cartridge having at least two lugs extending therefrom and through each of which an aperture is defined, said two apertures located in alignment with said two bosses and said two operation holes located in alignment with said central holes, two bolts respectively extending through said two apertures and engaged with said threaded recesses of said bosses, and an interior panel having a peripheral flange extending therefrom so as to mount to said base plate and said cartridge, two installation holes respectively defined through said interior panel and located in alignment with said operation holes.

2. The cartridge assembly as claimed in claim 1 wherein said base plate has at least one notch defined in a side thereof and said cartridge has at least one stud extending from said front wall thereof so as to be received in said notch.

* * * * *